US011819095B2

(12) United States Patent
Cheng

(10) Patent No.: US 11,819,095 B2
(45) Date of Patent: Nov. 21, 2023

(54) NOSE STUD USED FOR PERFORATING AND PERFORATING APPARATUS

(71) Applicant: Bo Cheng, NanChang (CN)

(72) Inventor: Bo Cheng, NanChang (CN)

( * ) Notice: Subject to any disclaimer, the term of this patent is extended or adjusted under 35 U.S.C. 154(b) by 155 days.

(21) Appl. No.: 17/438,517

(22) PCT Filed: Apr. 10, 2020

(86) PCT No.: PCT/CN2020/084095

§ 371 (c)(1),
(2) Date: Sep. 13, 2021

(87) PCT Pub. No.: WO2020/248685

PCT Pub. Date: Dec. 17, 2020

(65) Prior Publication Data

US 2022/0142310 A1 May 12, 2022

(30) Foreign Application Priority Data

Jun. 13, 2019 (CN) ..... 201910511001.5

(51) Int. Cl.
*A44C 15/00* (2006.01)
*A44C 7/00* (2006.01)

(52) U.S. Cl.
CPC ..... *A44C 15/0035* (2013.01)

(58) Field of Classification Search
CPC .... A01K 11/001; A01K 11/002; A44C 7/003; A44C 7/001
See application file for complete search history.

(56) References Cited

U.S. PATENT DOCUMENTS 2,086,518 A * 7/1937 Ashton ..... A01K 11/001 40/302
2,087,295 A * 7/1937 Pannier ..... A01K 11/001 40/302
2,309,030 A * 1/1943 Wittlinger ..... G09F 3/12 292/315

(Continued)

FOREIGN PATENT DOCUMENTS

CN 1200256 A 12/1998
CN 101583541 A 11/2009

(Continued)

OTHER PUBLICATIONS

International Search Report dated Jul. 14, 2020 in corresponding International application No. PCT/CN2020/084095; 7 pages.

(Continued)

*Primary Examiner* — Jack W Lavinder
(74) *Attorney, Agent, or Firm* — Maier & Maier, PLLC

(57) ABSTRACT

The present application provides a nose stud used for perforating and a perforating apparatus. The nose stud used for perforating comprises a needle tip and a needle bar, wherein the needle tip is connected to one end of the needle bar, and an easily bendable portion, which bends when the needle tip is subjected to a resistance force under a force applied by the needle bar, is provided at a joint. As a bendable structure is provided at the joint between the needle tip and the needle bar, the needle tip can bend relative to the needle bar after perforating the nose to avoid damaging tissues in the nasal cavity.

6 Claims, 7 Drawing Sheets

(56) References Cited

U.S. PATENT DOCUMENTS

| | | | | |
|---|---|---|---|---|
| 2,430,853 | A * | 11/1947 | Barger | A01K 11/002 227/144 |
| 4,041,946 | A | 8/1977 | Barton | |
| 4,146,032 | A | 3/1979 | Rubenstein et al. | |
| 4,527,563 | A | 7/1985 | Reil | |
| 5,496,343 | A | 3/1996 | Reil | |
| 5,669,929 | A * | 9/1997 | Reil | A44C 7/003 606/188 |
| 7,128,751 | B2 | 10/2006 | Reil | |
| 7,533,482 | B2 * | 5/2009 | Huenefeld | A01K 11/004 119/858 |
| 7,614,520 | B2 | 11/2009 | McEldowney et al. | |
| 7,975,520 | B2 | 7/2011 | McEldowney et al. | |
| 8,372,106 | B2 | 2/2013 | Reil et al. | |
| 9,764,433 | B2 * | 9/2017 | Giorlando | A44C 7/003 |
| 10,548,376 | B2 | 2/2020 | Reil et al. | |
| 2005/0216018 | A1 * | 9/2005 | Sennett | A61B 17/1671 606/79 |
| 2005/0268652 | A1 | 12/2005 | Hollis | |
| 2007/0278230 | A1 | 12/2007 | McEldowney et al. | |
| 2008/0287980 | A1 | 11/2008 | Blomdahl et al. | |
| 2010/0021270 | A1 | 1/2010 | McEldowney et al. | |
| 2016/0302538 | A1 * | 10/2016 | Morvillo | A44C 7/001 |
| 2018/0055160 | A1 * | 3/2018 | Reil | A44C 7/001 |
| 2018/0343988 | A1 | 12/2018 | Reil | |

FOREIGN PATENT DOCUMENTS

| | | | |
|---|---|---|---|
| CN | 205250565 | A | 5/2016 |
| CN | 108618285 | A | 10/2018 |
| CN | 208610027 | U | 3/2019 |
| DE | 94 19 830 | U1 | 3/1995 |
| GB | 2310378 | B | 6/1999 |
| GB | 2569126 | A | 6/2019 |

OTHER PUBLICATIONS

Chinese Office Action dated Sep. 22, 2020 in corresponding application No. 201910511001.5; 12 pages.

* cited by examiner

NOSE STUD USED FOR PERFORATING AND PERFORATING APPARATUS

The present application claims the priority from the Chinese Patent Application No. 201910511001.5, filed to the CNIPA on Jun. 13, 2019, titled "Nose Stud Used for Perforating and Perforating Apparatus", which is incorporated herein by reference in its entirety.

TECHNICAL FIELD

The present application belongs to the technical field of ornaments, and particularly relates to a nose stud used for perforating and a perforating apparatus.

BACKGROUND

It is a long-standing tradition of human beings to wear decorative nose studs perforating nose wings. A simpler method of perforating the nose wing is to pierce the nose wing with a hollow needle, and then wear the nose stud thereon by running through a hole formed by the hollow needle. This method takes a long time to operate, causes severe pain, and also has high technical requirements for operators.

At present, the commonly used nose stud, which is a stud with a needle tip, is disposable product. The needle tip 24 pierces the nose wing 1 directly. As shown in FIG. 1, the needle tip 24 of the nose stud is larger than a needle bar 23 in terms of diameter, so that the needle tip 24 is stuck in the nostril after the nose stud runs through the nose wing 1 to avoid the nose stud falling off. This nose stud has two deficiencies: first, the needle tip 24 that stays in the nostril often pricks tissues in the nasal cavity and causes pain due to inevitable movements of the nose stud; second, as the needle tip 24 is larger than the needle bar 23 in terms of diameter, the needle bar 23 cannot completely squeeze the wound caused by the needle tip 24 during perforating, resulting in wound bleeding after the perforating operation.

SUMMARY

Therefore, the technical problem to be solved in the present application is to provide a nose stud used for perforating and a perforating apparatus, which can avoid damaging tissues in the nasal cavity.

In order to solve the above deficiencies, the present application provides a nose stud used for perforating, comprising a needle tip and a needle bar, wherein the needle tip is connected to one end of the needle bar, and a bendable portion, which bends when the needle tip is subjected to a resistance force under a force applied by the needle bar, is provided at a joint.

Optionally, the bendable portion comprises a recess with the axial direction thereof not parallel to that of the needle bar.

Optionally, the axial direction of the recess is perpendicular to that of the needle bar.

Optionally, a top end of the needle tip is located outside an axis of the needle bar.

Optionally, the top end of the needle tip and an open side of the recess are both located on the same side of the axis; or, the needle tip and the needle bar are of a hollow structure.

Optionally, the needle tip forms an eccentric structure relative to the needle bar, and an axis of the needle tip is parallel to that of the needle bar.

Optionally, the recess is an annular recess coaxial with the needle bar.

Optionally, the needle tip and the needle bar are of equal outer diameter.

According to another aspect of the present application, a perforating apparatus is provided, comprising the nose stud used for perforating described above.

Optionally, the perforating apparatus comprises a cavity body, a piston body and a nose stud chuck, and the piston body is of an L-shaped structure with one end sliding into the cavity body and the other end having an inclined plane; the nose stud chuck clamping the nose stud used for perforating and directly facing the inclined plane is movably clamped on the cavity body; and when the piston body slides into the cavity body, the needle tip of the nose stud used for perforating bends upon contact with the inclined plane.

The nose stud used for perforating provided by the present application comprises a needle tip and a needle bar, wherein the needle tip is connected to one end of the needle bar, a bendable structure is provided at a joint which bends when the needle tip is subjected to a resistance force not in the axial direction of the needle bar under a force applied by the needle bar. As a bendable structure is provided at the joint between the needle tip and the needle bar, the needle tip can bend relative to the needle bar after perforating the nose to avoid damaging tissues in the nasal cavity.

BRIEF DESCRIPTION OF THE DRAWINGS

FIG. 12 shows a state of the perforating apparatus after perforating the nose wing according to the embodiment of the present application, in which:

1: nose wing; 22: nose stud head; 23: needle bar; 24: needle tip; 25: notch; 201: cavity body; 202: piston body;

203: spring; 204: nose stud chuck; 206: upper cavity; 207: guide rail; 208: top; 209: front wall; 210: rear wall; and 211: circular recess.

DETAILED DESCRIPTION

Referring to FIGS. 1 to 8, a nose stud used for perforating is provided according to an embodiment of the present application, comprising a needle tip 24 and a needle bar 23, wherein the needle tip 24 is connected to one end of the needle bar 23, and an easily bendable portion, which bends when the needle tip 24 is subjected to a resistance force under a force applied by the needle bar 23, is provided at a joint.

In use, the needle bar 23 applies force to the needle tip 24, and the needle tip 24 pierces the nose wing 1 until the needle bar 23 is located in a hole formed by the needle tip 24 piercing the nose wing 1. When the needle tip 24 is subjected to a resistance force, the resistance force will cause the bendable portion at the joint between the needle tip 24 and the needle bar 23 to bend. In this way, the needle tip 24 bent to one side is less likely to prick tissues in the nasal cavity, thus alleviating pain. At the same time, the bent needle tip 24 forms a blocking structure to prevent the nose stud from falling off the nose wing 1.

The above bendable portion refers to a portion that is more likely to bend without deformation caused by fracture than the needle bar and the needle tip under the action of a stress transmitted hereto by a force in the direction from the needle bar to the needle tip.

For example, the easily bendable portion comprises a recess, the axial direction of the recess is non-parallel to the axial direction of the needle bar. When the needle tip 24 is subjected to a non-axial resistance, the needle tip 24 is more likely to bend at the recess, especially when the axial direction of the recess is perpendicular to that of the needle bar 23.

Optionally, a top end of the needle tip 24 is located outside the axis of the needle bar 23 and on an open side of the recess. In this way, when a top end of the needle tip 24 is subjected to a counter-acting force, the needle tip 24 is more likely to buckle at the recess.

Embodiment 1

Figure 1:
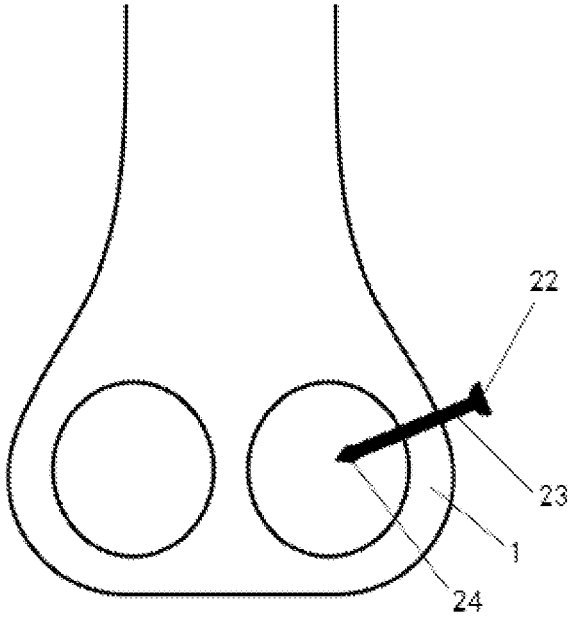
FIG. 1 is a schematic diagram of a nose stud used for perforating nose wings in the prior art.
Figure 2:
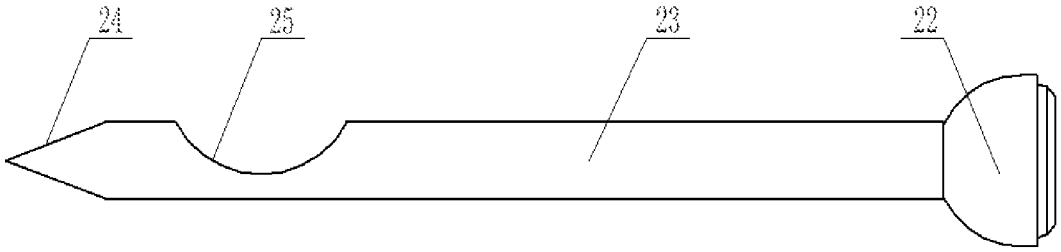
FIG. 2 is a structural diagram of the nose stud used for perforating according to an embodiment of the present application.
Figure 3:
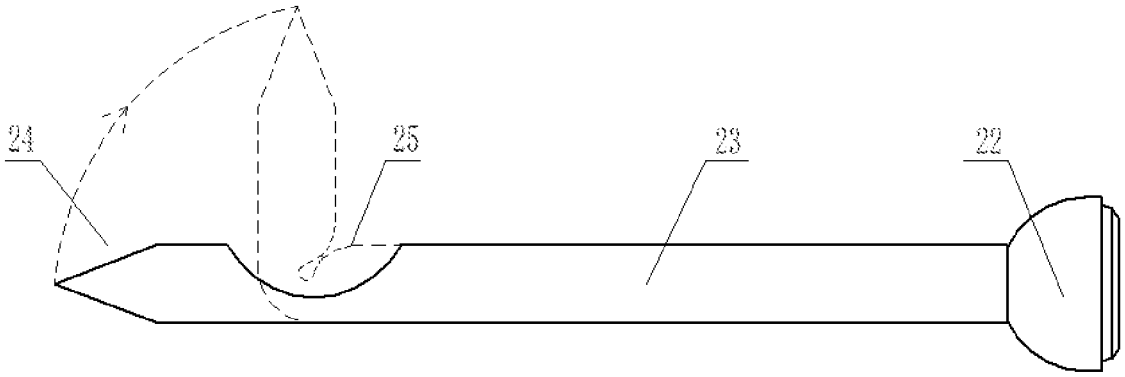
FIG. 3 is a schematic diagram of the nose stud used for perforating deformed by force according to the embodiment of the present application.

As shown in FIGS. 2 and 3, the nose stud used for perforating is of an integrated structure consisting of a needle tip 24, a needle bar 23 and a nose stud head 22, and a notch 25 is provided at a joint between the needle tip 24 and the needle bar 23. After the needle tip 24 pierces the nose wing 1, the needle tip 24 is subjected to a resistance force that deviates slightly, and the needle tip 24 bends to an open side of the notch 25 at the notch 25 until it bends to 90 degrees, as shown in FIG. 3.

Embodiment 2

Figure 4:
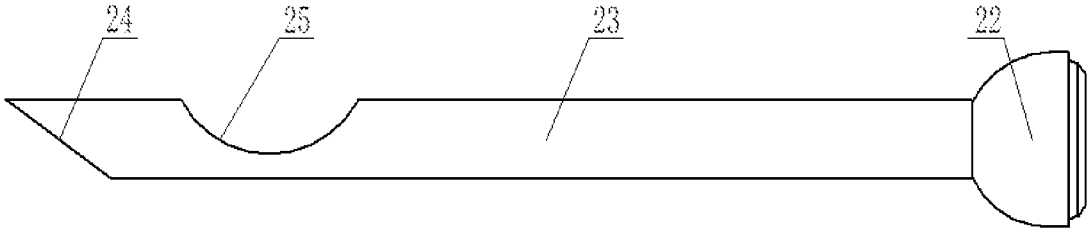
FIG. 4 is a structural diagram of a nose stud used for perforating according to another embodiment of the present application.
Figure 5:
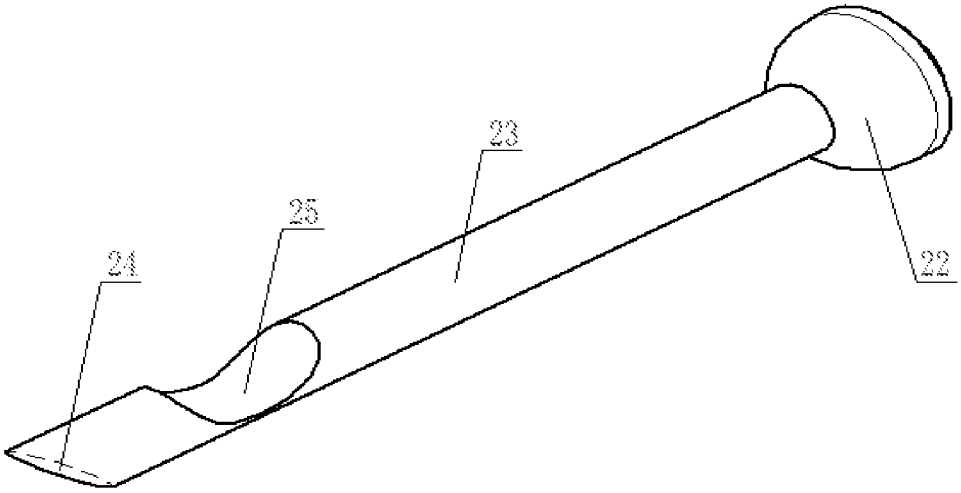
FIG. 5 is a perspective view of the nose stud used for perforating in FIG. 4 according to the embodiment of the present application.

Unlike Embodiment 1, the needle tip 24 is of an inclined structure. As shown in FIGS. 4 and 5, the top end of the needle tip 24 and an open side of the notch 25 are located on the same side. The force applied by the needle bar 23 to the needle tip 24 will cause the needle tip 24 to bend at the notch 25.

Embodiment 3

Figure 6:
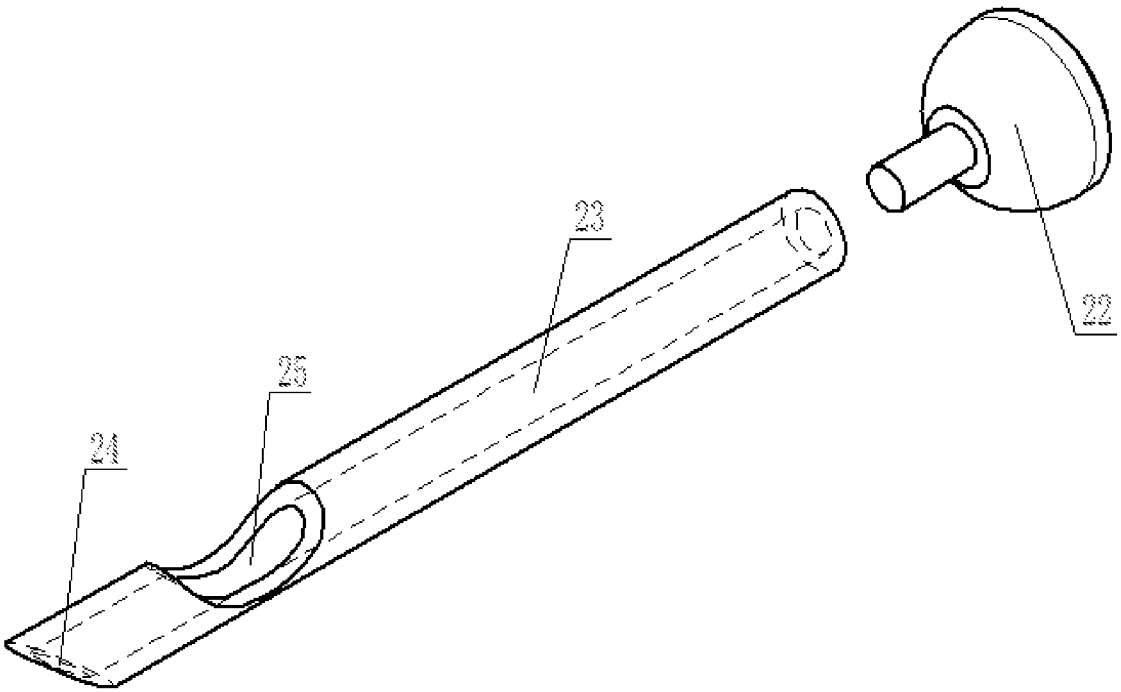
FIG. 6 is a structural diagram of a nose stud used for perforating according to a third embodiment of the present application.

Unlike Embodiment 2, the needle tip 24 and the needle bar 23 are of an integrated hollow structure, and the nose stud head 22 is a moving piece. As shown in FIG. 6, when the needle bar 23 applies force to the needle tip 24, the needle tip 24 bends at the notch 25 under the action of counter-acting force.

Embodiment 4

Figure 7:
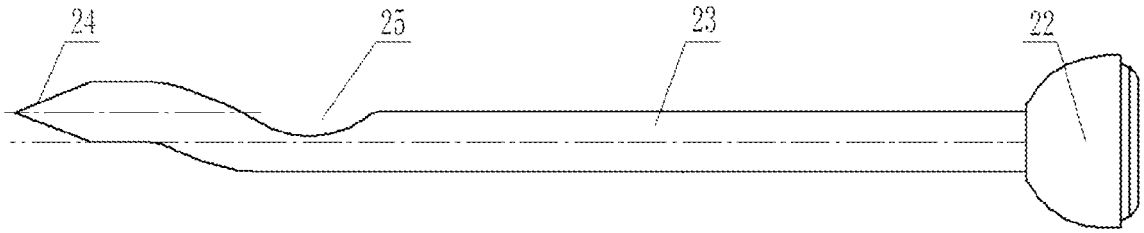
FIG. 7 is a structural diagram of a nose stud used for perforating according to a fourth embodiment of the present application.

Unlike Embodiment 1, the needle tip 24, with an axis parallel to that of the needle bar 23, is of an eccentric structure relative to the needle bar 23. As shown in FIG. 7, the needle tip 24 is deflected to one side. When the needle bar 23 applies force to the needle tip 24, the needle tip 24 bends at the notch 25 under the action of counter-acting force.

Embodiment 5

Figure 8:
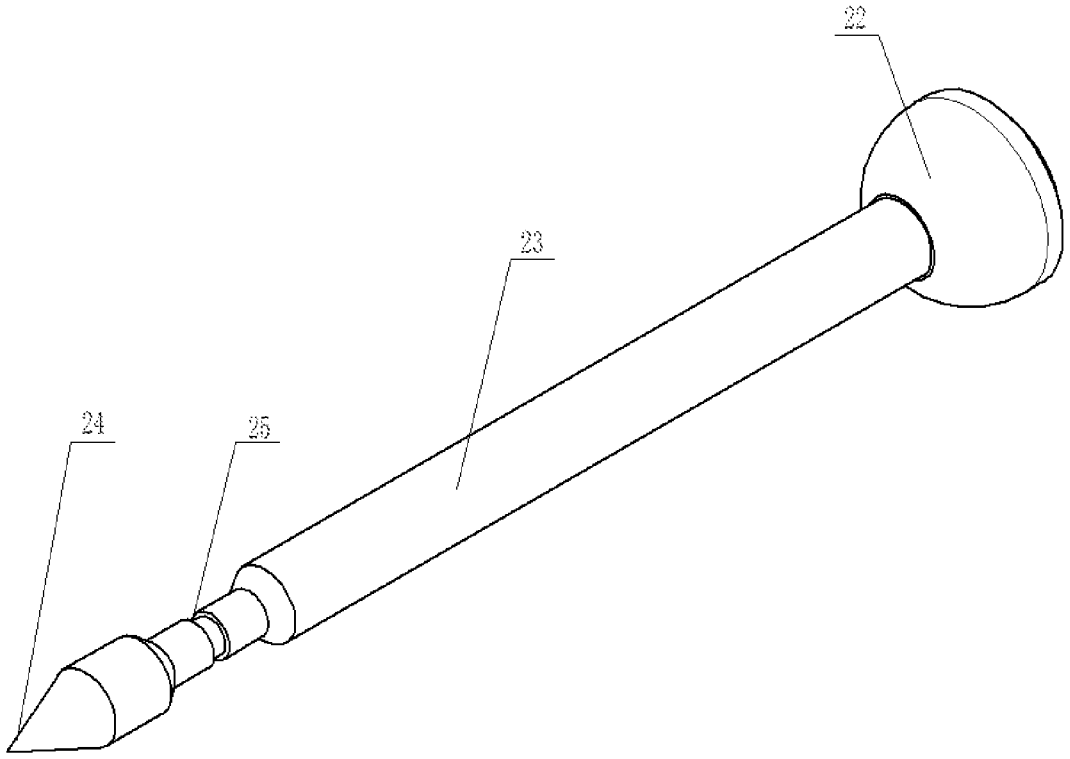
FIG. 8 is a structural diagram of a nose stud used for perforating according to a fifth embodiment of the present application.
Figure 9:
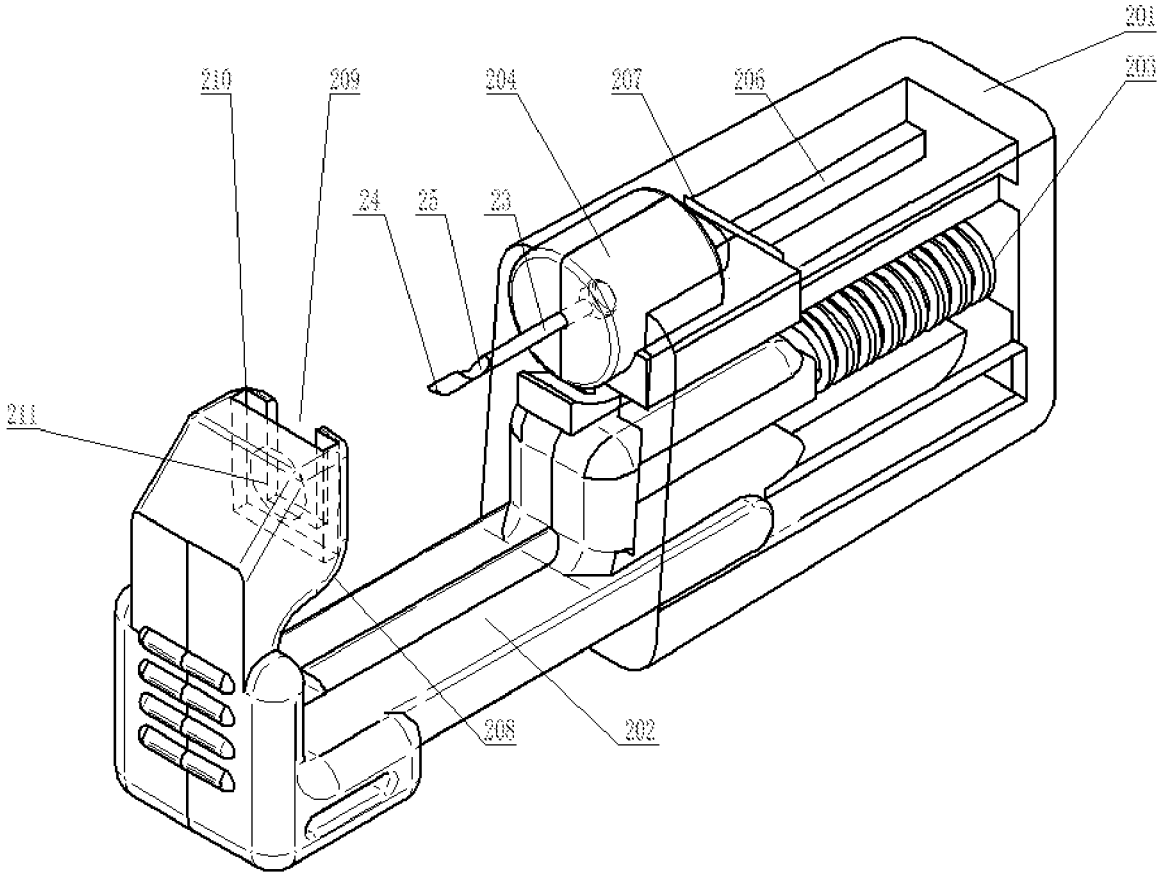
FIG. 9 is a structural diagram of a perforating apparatus according to an embodiment of the present application.
Figure 10:
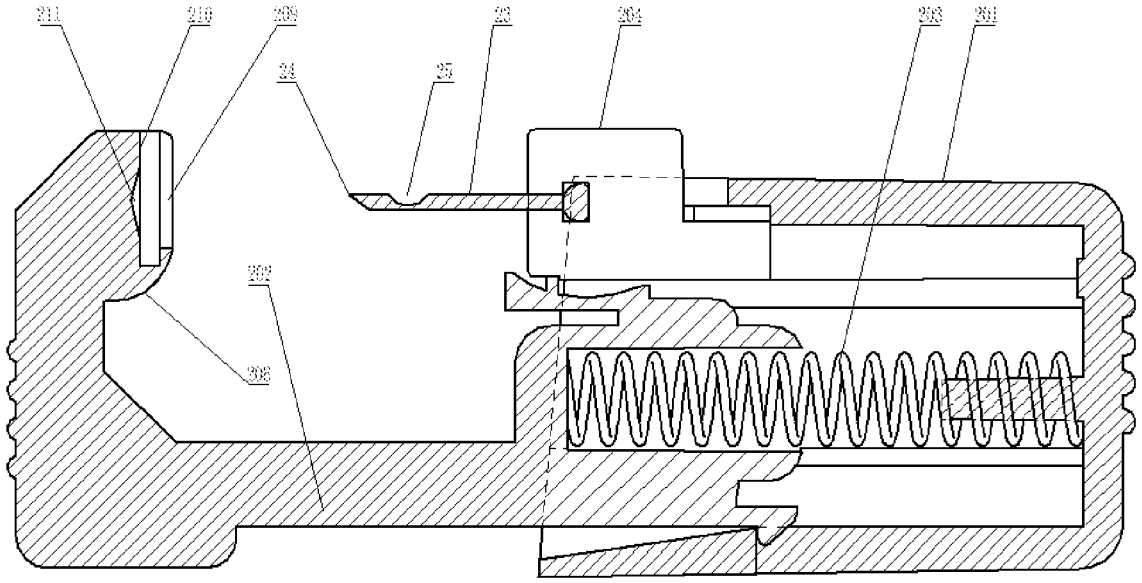
FIG. 10 is a sectional view of the perforating apparatus in FIG. 9 according to the embodiment of the present application.

Unlike Embodiment 1, the recess is an annular recess coaxial with the needle bar. As shown in FIG. 8, when the needle bar 23 applies force on the needle tip 24, the needle tip 24 bends at the annular recessunder the action of counter-acting force applied by the inclined plane as the counter-acting force is not in the direction of the axis of the needle bar 23.

In production practice, the above structure can be implemented in a variety of ways. The needle bar 23 and the needle tip 24 may be integrated; the needle bar 23 and the nose stud head 22 may be connected by glue or threads and may also be integrated.

In production practice, the needle tip 24 and the needle bar 23 may be of equal outer diameter, and a hole formed by the needle tip 24 on the nose wing 1 will be blocked by the needle bar 23 to avoid wound bleeding.

Referring to FIGS. 9 to 12, a perforating apparatus is provided according to an embodiment of the present application, comprising the nose stud used for perforating described above.

Specifically, the perforating apparatus comprises a cavity body 201, a piston body 202 and a nose stud chuck 204. The piston body 202 is of an L-shaped structure with one end sliding into the cavity body 201 and the other end having an inclined plane; the nose stud chuck 204 clamping the nose stud used for perforating and directly facing the inclined plane is movably clamped on the cavity body 201. When the piston body 202 slides into the cavity body 201, the needle tip 24 of the nose stud used for perforating bends upon contact with the inclined plane.

The cavity body 201 is of a structure consisting of an upper cavity 206 and a lower cavity. A guide rail 207, on which the nose stud chuck 204 is clamped and can move, is provided in the upper cavity 206. One end of the piston body 202 slides in the lower cavity, and a spring 203 is provided between the piston body 202 and the cavity body 201. At the other end, a top 208, which is a recess structure with one side open, directly faces the nose stud chuck 204, the open side is a front wall 209, and a conical recess or bulge 211 is provided at the center of a rear wall 210 to form an inclined surface structure in contact with the needle tip 24.

Figure 11:
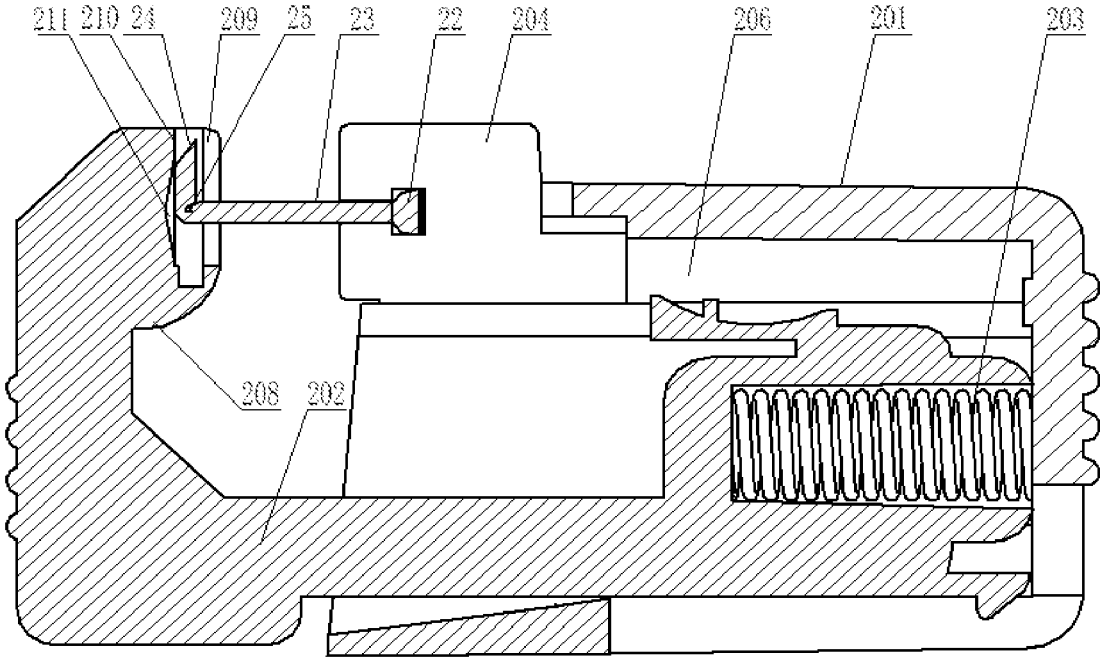
FIG. 11 shows a state of the perforating apparatus in use according to the embodiment of the present application.
Figure 12:
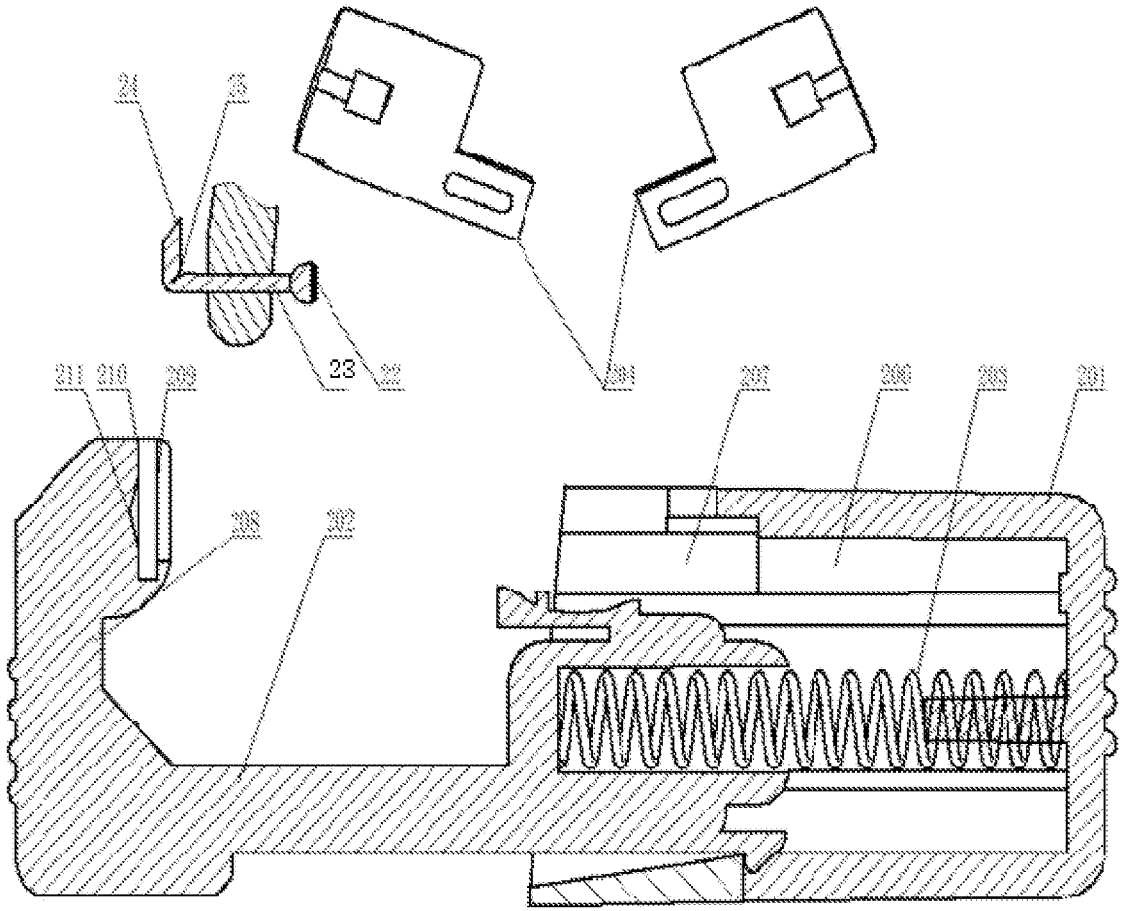

FIGS. 11 and 12 show an operating principle of the perforating apparatus adopting the nose stud used for perforating. When the cavity body 201 and the piston body 202 are pinched by hand and approached, the spring 203 is compressed, and the needle tip pierces the nose wing 1 and passes through the opening of the front wall 209 into the conical recess or onto bulge 211 of the rear wall 210. The needle tip 24 bends at a notch 25 under the action of a thrust force to form a bending structure with an included angle of about 90 degrees with the needle bar 23. When the pinching force applied by hand is removed, the cavity body 201 and the piston body 202 are separated under the action of the spring 203, the nose stud chuck 204 is disengaged from the guide rail 207 and falls off the nose stud head 22, and finally the nose stud remains on the nose wing 1. At this moment, the perforating process of the nose stud is completed.

It should be readily understood by those of skill in the art that the above technical features may be freely combined and superimposed without conflict.

Those described above are not intended to limit the present application but merely preferred embodiments of the present application. Any modifications, equivalents and improvements made within the spirit and principle of the present application shall fall into the protection scope of the present application. Those described above are merely preferred embodiments of the present application. It should be noted that a number of improvements and variations may be made by those of ordinary skill in the art without departing from the technical principles of the present application, and such improvements and variations shall also fall into the protection scope of the present application.

The invention claimed is:

1. A nose stud used for perforating, comprising a needle tip and a needle bar, wherein the needle tip is connected to one end of the needle bar, and a bendable portion, which bends when the needle tip is subjected to a resistance force under a force applied by the needle bar, is provided at a joint, wherein the bendable portion comprises annular recess coaxial with the needle bar.

2. The nose stud used for perforating according to claim 1, wherein a top end of the needle tip is located outside an axis of the needle bar.

3. The nose stud used for perforating according to claim 2, wherein the needle tip forms an eccentric structure relative to the needle bar, and an axis of the needle tip is parallel to that of the needle bar.

4. A perforating apparatus, comprising the nose stud used for perforating according to claim 1.

5. The perforating apparatus according to claim 4, wherein the perforating apparatus comprises a cavity body, a piston body and a nose stud chuck, and the piston body is of an L-shaped structure with one end sliding into the cavity body and the other end having an inclined plane; the nose stud chuck clamping the nose stud used for perforating and directly facing the inclined plane is movably clamped on the cavity body; and when the piston body slides into the cavity body, the needle tip of the nose stud used for perforating bends upon contact with the inclined plane.

6. A nose stud used for perforating, comprising a needle tip and a needle bar, wherein the needle tip is connected to one end of the needle bar, and a bendable portion, which bends when the needle tip is subjected to a resistance force under a force applied by the needle bar, is provided at a joint, wherein a top end of the needle tip is located outside an axis of the needle bar, and wherein the needle tip forms an eccentric structure relative to the needle bar, and an axis of the needle tip is parallel to that of the needle bar.

* * * * *